United States Patent [19]

Washecheck et al.

[11] 4,375,360

[45] Mar. 1, 1983

[54] METHANOL FUEL AND METHANOL FUEL ADDITIVES

[75] Inventors: Paul H. Washecheck, Ponca City, Okla.; Andrew T. C. Liu, Houston, Tex.; E. Flynt Kennedy, Ponca City, Okla.

[73] Assignee: Conoco Inc., Ponca City, Okla.

[21] Appl. No.: 223,980

[22] Filed: Jan. 12, 1981

[51] Int. Cl.[3] ..... C10L 1/18

[52] U.S. Cl. ..... 44/53; 44/56; 44/66

[58] Field of Search ..... 44/53, 56, 66; 252/56 R, 57

[56] References Cited

U.S. PATENT DOCUMENTS

| | | | |
|---|---|---|---|
| 2,560,202 | 7/1951 | Zimmer | 44/66 |
| 2,585,843 | 2/1952 | Rogers | 44/66 |
| 2,976,245 | 3/1961 | Copes | 44/66 |
| 4,185,594 | 1/1980 | Perilstein | 44/53 |
| 4,282,007 | 8/1981 | Sung | 44/53 |

*Primary Examiner*—Jacqueline V. Howard

*Attorney, Agent, or Firm*—Cortlan R. Schupbach, Jr.

[57] ABSTRACT

Methanol fuels are modified by the addition of materials which provide required lubricity and protection for engine parts while retaining compatability with the methanol fuel. Methanol fuel is methanol itself or any fuel containing a majority of methanol by volume. In addition, these additives help lubricate cylinder walls and decrease wear and corrosion.

7 Claims, No Drawings

METHANOL FUEL AND METHANOL FUEL ADDITIVES

This invention relates to the preparation of synthetic fuels and the synthetic fuels obtained thereby. More specifically, this invention relates to the use of methanol as the major component in a fuel or as the fuel itself to replace gasoline, said fuel containing lubricants and antioxidants to enhance useability.

Methanol is well known as a synthetic fuel to replace gasoline. However, many problems are encountered with the use of methanol as a fuel. Methanol is an extremely poor lubricant. The lack of lubricity causes problems in pumping fuel from the fuel tank to the combustion chamber. Within the firing cylinder itself, gasoline acts as a lubricant to assist in the movement of the piston. Methanol lacks this lubricating quality and causes additional cylinder wear. The products of a partial combustion of methanol are formaldehyde and formic acid which are corrosive to metallic parts. Thus if the cylinder wall is not protected by additives, the partial combustion products lead to corrosion and increased wear of the cylinder walls, piston or piston rings.

In addition, pure methanol fuels have a very severe cold weather starting problem. In fact, it has been recorded that engine starting is essentially impossible below 50° F. without the use of starting aid, as reported in Keller J. L. *Alcohols as Motor Fuel Hydrocarbon Processing,* May, 1979 and *Methanol and Methanol Fuels for Modern Cars* at the API meeting, San Francisco, May, 1979. At approximately 48° F. methanol is too lean to fire. In this case, volatile materials such as propane, butane, isopentane, and ether have proven satisfactory starting aids for neat methanol as described in *Alcohols; A Technical Assessment of Their Application as Fuels,* API publication No. 4261 July, 1976. These starting aids may be added to the methanol or can be injected from a separate auxiliary tank. The amount and type of starting aid needed is dependent upon the temperatures encountered. As much as 30% has been reported necessary for temperatures in the −30° F. range by Keller at the API meeting, May, 1979. Butane has been found to be one of the better starting aids, but like many others, increases the volatility to undesirable proportiona.

Using neat methanol as a fuel introduces certain new problems that do not exist with gasoline/methanol blends. An automobile designed to operate with gasoline will not operate with alcohol (API publication 4261). The fuel system as designed is incapable of delivering the quantity of alcohol needed to produce a combustible air/methanol mixture. However, the cost for modification for alcohol fuel is modest if included in a new car design. Once refitting is done, other problems of engine operation on 100% methanol fuel from a performance standpoint are normally encountered.

Because of the much higher latent heat of evaporation (some 7 times that of gasoline), it is necessary to redesign fuel intake systems to insure a proper air fuel distribution. Therefore, unless extensively modified, cars designed to run on gasoline will not run on alcohols in the absence of specific additives.

Methanol, neat, as a fuel produces excessive wear on cylinder walls, rings and bearings and simulated stop and go drivings as reported by Owens in *Methanol Fuel Effects on Spark Ignition Engine Lubrication and Wear,* International Symposium on alcohol fuel technology, methanol and ethanol, Westburg, Germany, November, 1977, in combination with Marback, *Effects of Alcohol Fuels on Engine Wear,* Society of Automotive Engineers Paper 800857. Ford Motor Company reported the use of methanol in a modified 2.3 liter engine noting that bearing wear was excellent but cam and rocker wear was more excessive than with gasolines; Nickles, R. J. *Modification of a Ford Pinto for Operation on Methanol,* Alcohols Fuels Technology, 3rd International Symposium, ASI, Lomar, California, 1979. However, methanol has several advantages, assuming lubricity problems could be solved. For example, methanol produces about 10% more power than does gasoline at the same mixture strength and with spark set for best torque, and also extends the lean misfire limit. In addition, slightly less energy consumption for equivalent power output would be expected.

Attempts have been made to overcome many of the lubricity problems of methanol by adding other components to the methanol fuel in trace quantities. Paraffinic hydrocarbons commonly used as engine lubricants are unacceptable due to the lack of solubility in the methanol fuel. In the race car industry, resort has been made to exotic substances such as castor oil (12-hydroxy-9-octadecenoic acid triglyceride) to provide the required lubricity. However, such exotic substances are expensive and not available for large scale consumption.

It would therefore be of great benefit to provide a method for providing methanol fuels with the required lubricity. In addition, the material used for lubricity should help prevent corrosion.

It is therefore an object of the present invention to provide additives for methanol fuel and neat methanol to increase lubricity. Other objects will be apparent to those skilled in this art as the description proceeds.

We have now discovered that methanol fuels can be modified by the addition of a material or a mixture of materials which provide the required lubricity and protection while retaining compatibility with the methanol fuel. These additives can be a material or a mixture of materials selected from the group consisting of (a) fatty alcohols having the general formula ROH, where R is a linear or branched acyclic, alicyclic, cyclic, or aryl group containing from 6 to 30 carbon atoms;

(b) alcohol ethoxylates having the general formula $RO(CH_2CH_2O)_xH$, where R is a linear or branched acyclic, alicyclic, cyclic, or aryl group containing from 6 to 30 carbon atoms and x is from 1 to 20;

(c) fatty acids having the general formula $RCO_2H$, where R is a linear or branched acyclic, alicyclic, cyclic, or aryl group containing from 6 to 30 carbon atoms;

(d) fatty acid ethoxylates having the general formula $RCO_2(CH_2CH_2O)_xH$, where R is a linear or branched acyclic, alicyclic, cyclic, or aryl group containing from 6 to 30 carbon atoms and x is from 1 to 20;

(e) dialkylbenzenes having the general formula where $R_1$ and $R_2$ are, independently, linear or branched acyclic, alicyclic, cyclic, or aryl groups containing from 1 to 20 carbon atoms and the total number of carbon atoms in $R_1$ and $R_2$ is from 8 to 36;

(f) monoesters having the general formula $R_1CO_2R_2$ where $R_1$ and $R_2$ are, independently, linear or branched acyclic, alicyclic, cyclic, or aryl groups containing from 1 to 30 carbon atoms and the total number of carbon atoms in $R_1$ and $R_2$ is from 10 to 40;

(g) diesters having the general formula $R_1O_2CR_2CO_2R_3$, where $R_1$, $R_2$, and $R_3$ are, independently, linear or branched acyclic, alicyclic, cyclic, or aryl groups containing from 1 to 30 carbon atoms and the total number of carbon atoms in $R_1$, $R_2$, and $R_3$ is from 10 to 50.

(h) polyol esters having the general formula $$R_1(CH_2O\overset{\overset{\displaystyle O}{\|}}{C}R_2)_x,$$

where $R_1$ and $R_2$ are, independently, linear or branched acyclic, alicyclic, cyclic, or aryl groups containing from 1 to 30 carbon atoms and x is 2–4; and the total number of carbon atoms in $R_1$ and $R_2$ is from 10 to 40.

(i) poly(alkyleneglycols) having the general formula $$R_1O(CH_2\underset{\underset{\displaystyle R_2}{|}}{C}HO)_xR_3,$$

where $R_1$, $R_2$, and $R_3$ are, independently, hydrogen or linear or branched alkyl groups and x is 1–100;

(j) phosphate esters having the general formula $$R_1\,O\overset{\overset{\displaystyle O}{\|}}{P}OR_3,$$
$$\underset{\underset{\displaystyle OR_2}{\|}}{}$$

where $R_1$, $R_2$, and $R_3$ are, independently, linear or branched acyclic, alicyclic, cyclic, or aryl groups and the total number of carbon atoms in $R_1$, $R_2$, and $R_3$ is 6–40.

(k) olefin-carboxylic acid copolymers (l) vinyl alcohol polymers and copolymers

Normally, additives will be most useful in applications where methanol constitutes a majority of the fuel by volume. However, clearly these additives will be the most effective where the fuel is substantially totally methanol. In fuels which are substantially totally methanol, the additives will normally be present at levels ranging from about 0.05% to about 15% by volume. More common levels of use will be from about 0.1% to about 10% by volume and most preferred levels will be from about 0.5 to about 5% by volume.

Representative examples of fatty alcohols useful in the present invention are those derived by hydrogenation of natural fats and oil such as CO and TA alcohols, trademark of and sold by Procter and Gamble Companies such as CO-1214 N alcohol, CO-1618 alcohol, and TA-1618 alcohol, and ADOL alcohols, trademark of and sold by Ashland Oil Company, such as ADOL 54 alcohol, ADOL 61 alcohol, ADOL 64 alcohol, ADOL 60 alcohol, and ADOL 66 alcohol. Alcohols produced by Ziegler chemistry can also be used. Examples of these are ALFOL alcohols, trademark of and sold by Conoco Inc. such as ALFOL 1012 alcohol, ALFOL 1214 alcohol, and ALFOL 1412 alcohol, ALFOL 1618 alcohol, ALFOL 1620 alcohol. In addition, EPAL alcohols, trademark of and sold by Ethyl Chemical Company can be used, such as EPAL 1012 alcohol, EPAL 1214 alcohol, EPAL 1418 alcohol.

Oxo alcohols produced by hydroformylation from olefins can also be used, such as the NEODOL alcohols, trademark of and sold by Shell Oil Company, such as NEODOL 23 alcohols, NEODOL 25 alcohol, NEODOL 45 alcohol, the TERGITOL alcohols, trademark of and sold by Union Carbide Corporation such as TERGITOL L-125 alcohol, and LIAL alcohols, trademark of and sold by Liquichimica Company such as LIAL 125. Guerbet alcohols can also be used such as STANDAMUL alcohols, trademark of and sold by Henkel Chemical Company, succh as STANDAMUL GT-12 alcohols, STANDAMUL GT-16 alcohols, STANDAMUL GT-20 alcohols, and STANDAMUL GT-1620 alcohols.

In general, alcohols that can be used are 1-decanol, 1-undecanol, 1-docecanol, 1-tridecanol, 1-tetradecanol, 1-pentadecanol, 1-hexadecanol, 1-heptadecanol, 1-octadecanol, 1-nonadecanol, 1-eicosanol, 1-docosanol, 2-methyl-1-undecanol, 2-propyl-1-nonanol, 2-butyl-1-octanol, 2-methyl-1-tridecanol, oleyl alcohol, 2-octadecanol, 2-ethyl-1-dodecanol; 2-propyl-1-undecanol; 2-butyl-1-decanol; 2-pentyl-1-nonanol; 2-hexyl-1-octanol; 2-methyl-1-pentadecanol; 2-ethyl-1-tetradecanol; 2-propyl-1-tridecanol; 2-butyl-1-dodecanol; 2-pentyl-1-undecanol; 2-hexyl-1-decanol; 2-heptyl-1-decanol; 2-hexyl-1-nonanol; 2-octyl-1-octanol; 2-methyl-1-heptadecanol; 2-ethyl-1-hexadecanol; 2-propyl-1-pentadecanol; 2-butyl-1-tetradecanol; 1-pentyl-1-tridecanol; 2-hexyl-1-dodecanol; 2-octyl-1-decanol; 2-nonyl-1-nonanol; 2-dodecanol; 3-dodecanol; 2-octyl-1-decanol; 2-nonyl-1-nonanol; 2-dodecanol; 3-dodecanol; 4-dodecanol; 5-dodecanol; 6-dodecanol; 2-tetradecanol; 3-tetradecanol; 4-tetradecanol; 5-tetradecanol; 6-tetradecanol; 7-tetradecanol; 2-hexadecanol; 3-hexadecanol; 4-hexadecanol; 5-hexadecanol; 6-hexadecanol; 7-hexadecanol; 8-hexadecanol; 2-octadecanol; 3-octadecanol; 4-octadecanol; 5-octadecanol; 6-octadecanol; 7-octadecanol; 8-octadecanol; 9-octadecanol; 2,4,6-trimethyl-1-heptanol; 2,4,6,8-tetramethyl-1-nonanol; 3,5,5-trimethyl-1-hexanol; 3,5,5,7,7-pentamethyl-1-octanol; 3-butyl-1-nonanol; 3-butyl-1-undecanol; 3-hexyl-1-undecanol; 3-hexyl-1-tridecanol; 3-octyl-1-tridecanol; 2-methyl-2-undecanol; 3-methyl-3-undecanol; 4-methyl-4-undecanol; 2-methyl-2-tridecanol; 3-methyl-3-tridecanol; 4-methyl-3-tridecanol; 4-methyl-4-tri-decanol; 3-ethyl-3-decanol; 3-ethyl-3-dodecanol; 2,4,6,8-tetramethyl-2-nonanol; 2-methyl-3-undecanol; 2-methyl-4-undecanol; 4-methyl-2-undecanol; 5-methyl-2-undecanol; 4-ethyl-2-decanol; 4-ethyl-3-decanol; tetracosanol; hexacosanol; octacosanol; triacontanol; dotriacontanol; hexatriacontanol; 2-decyltetradecanol; 2-dodecylhexadecanol; 2-tetradecyloctadecanol; 2-hexadecyleicosanol.

Representative examples of alcohol ethoxylates which can be used in the practice of the present invention are generally the ethoxylates of the fatty alcohols previously described such as ALFONIC ethoxylates, trademark of and sold by Conoco Inc. such as ALFONIC 1618-65, a 65% ethoxylated material, and ALFONIC 1412-40, and 1412-60; the NEODOL ethoxylates, trademark of and sold by Shell Chemical Company, such as NEODOL 25-9, NEODOL 23-7, and NEODOL 45-12. In addition, ethoxylates sold by Union Carbide such as TERGITOL 15 S-9 and TERGITOL 25L-9 can be used. In particular, nonylphenol ethoxylate is an efficient material in the practice of the instant invention.

Representative examples of fatty acids useful in the practice of the present invention are myristic acid, stearic acid, palmitic acid, and oleic acid.

Representative examples of fatty acid ethoxylates useful in the process of the present invention are stearic acid ethoxylate, palmitic ethoxylate, oleic acid ethoxylate, and myristic acid ethoxylate.

Representative examples of dialkylbenzenes useful in the practice of the instant invention are didodecylbenzene and hexyldecylcumene.

Representative examples of monoesters useful in the practice of the instant invention are methyl stearate, butyl stearate, octyl isostearate, isotridecyl heptanoate, decyl oleate, isopropyl myristate, and isopropyl palmitate.

Representative examples of diesters useful in the practice of the present invention are dioctyl phthalate, diisodecyl adepate, diisotridecyl adipate, dibutyl phthalate, diisodecyl adipate, diisodecyl azelate, ALFOL 1610 phthalate, trademark of and sold by Conoco Inc. diisononyl isophthalate, di-2-butyl-octyl adipate, di(2-ethyl-hexyl)phthalate, Monsanto 79 and 711 phthalate, trademark of and sold by Monsanto Chemical Company, and Shell 911 esters, trademark of and sold by Shell Chemical Company.

Representative examples of polyol esters useful in the practice of the present invention are pentaerythritol valerate, trimethylolpropane nonoate, neopentylglycol octoate, and pentaerythritol heptanoate.

Representative examples of polyalkene glycols useful in the practice of the present invention are triethylene glycol, polyethylene glycol, polypropylene glycol, and tetraglyme.

Representative examples of phosphate esters useful in the practice of the present invention are tricresyl phosphate, cresyldiphenyl phosphate, isopropylphenyl diphenyl phosphate, trixylenyl phosphate, trioctyl phosphate, and dimethyldodecyl phosphate.

Representative examples of olefin carboxylic acid copolymers useful in the practice of the present invention are ethylene-acrylic acid copolymer ethyl-methacrylic acid copolymer, isobutylene-maleic acid copolymer, ethylene-fumaric acid copolymer, and hexane-acrylic acid copolymer.

Representative examples of vinyl alcohol polymers and copolymers are poly(vinyl alcohol), ethylene-vinyl alcohol copolymer, decene-vinyl alcohol copolymer, and vinyl alcohol-vinyl acetate copolymer.

In general, the additives are simply added to the methanol fuel in the desired amount and agitated for a time sufficient to dissolve or disperse the additive. Such additives can be used with other fuel additives such as stabilizers and dyes which do not cause harmful reactions with the additives of the present invention.

The instant invention is more concretely described with reference to the examples below wherein all parts and percentages are by volume unless otherwise specified. The examples are to exemplify the instant invention and not to limit it.

EXAMPLE 1

Methanol (1000 liters) is blended with 10 liters ALFOL 1214 alcohol (trademark of and sold by Conoco Inc.) in a stirred tank. The mixture is agitated gently to ensure that the higher alcohol is dissolved and mixed uniformly in the methanol. This fuel blend has better lubricity and produces less engine wear than methanol alone.

EXAMPLE 2

Methanol (1000 liters) is blended with 5 liters diisoctyl adipate in a stirred tank. The mixture is agitated gently to ensure that the diester is dissolved and mixed uniformly in the methanol. This fuel blend has better lubricity and produces less wear on various engine parts than methanol alone.

EXAMPLE 3

Methanol (1000 liters) is blended with 20 liters NEODOL 23-7 ethoxylate (NEODOL alcohols trademark of and sold by Shell Oil Co.) in a stirred tank. The mixture is agitated gently to ensure that the ethoxylate is dissolved and mixed uniformly in the methanol. This fuel blend has better lubricity and produces less wear and corrosion than methanol alone.

EXAMPLE 4

Methanol (1000 liters) is blended with 50 liters didodecylbenzene, a mixture of isomers prepared by alkylation of benzene, in a stirred tank. The mixture is agitated to ensure that the hydrocarbon is dissolved and mixed uniformly in the methanol. This fuel blend has better lubricity and produces less engine wear than methanol alone.

EXAMPLE 5

Methanol (1000 liters) is blended with 1 liter oleic acid as it is pumped into a storage tank. Oleic acid is metered into the flowing stream of methanol such that a uniform blend results. This fuel blend has better lubricity and results in less wear on various engine parts than methanol alone.

EXAMPLE 6

Vinyl acetate is polymerized to form poly(vinyl acetate). The polymer is partially hydrolyzed resulting in a copolymer of vinyl alcohol and vinyl acetate. This copolymer (3 kg) is blended with 1000 liters methanol in a stirred tank. The mixture is agitated gently to ensure that the polymer is dissolved and mixed uniformly in the methanol. This fuel blend has better lubricity than methanol alone.

EXAMPLE 7

Methanol (1000 liters) is blended with 15 liters butyl stearate in a stirred tank. The mixture is agitated to ensure that the ester is dissolved and mixed uniformly in the methanol. This fuel blend has better lubricity and produces less engine wear than methanol alone.

EXAMPLE 8

Methanol (1000 liters) is blended with 10 liters stearic acid ethoxylate in a stirred tank. The mixture is agitated gently to ensure that the ethoxylate is dissolved and mixed uniformly in the methanol. This fuel blend has better lubricity and produces less wear and corrosion than methanol alone.

EXAMPLE 9

Methanol (1000 liters) is blended with 2 liters tricresyl phosphate as it is pumped into a storage tank. Tricresyl phosphate is metered into the flowing methanol stream such that a uniform blend results. This fuel blend has better lubricity and produces less wear and corrosion tank methanol alone.

EXAMPLE 10

Methanol (1000 liters) is blended with 8 liters pentaerythritol heptanoate is a stirred tank. The mixture is agitated to ensure that the polyol ester is dissolved and mixed uniformly in the methanol. This fuel blend has better lubricity which results in less engine wear than methanol alone.

EXAMPLE 11

Isobutylene is copolymerized with maleic anhydride. The resulting copolymer is hydrolyzed to produce an isobutylenemaleic acid copolymer. This copolymer (2 kg) is blended with 1000 liters methanol in a stirred tank. The mixture is agitated gently to ensure that the copolymer is dissolved and mixed uniformly in the methanol. This fuel blend has better lubricity and produces less wear on various engine parts than methanol alone.

EXAMPLE 12

Methanol (1000 liters) is blended with 6 liters polyethylene glycol in a stirred tank. The mixture is agitated to ensure that the glycol is dissolved and mixed uniformly in the methanol. This fuel blend has better lubricity which results in less engine wear than methanol alone.

EXAMPLE 13

Methanol (1000 liters) is blended with 2 liters dioctyl phthalate and 3 liters ALFONIC 1214-60 ethoxylate (trademark of and sold by Conoco Inc.) in a stirred tank. The mixture is agitated gently to ensure that the additives are dissolved and mixed uniformly in the methanol. This fuel blend has better lubricity and produces less engine wear than methanol alone.

EXAMPLE 14

Methanol (1000 liters) is blended with 1 liter tricresyl phosphate and 2 liters trimethylolpropane nonoate in a storage tank. The mixture is agitated by pumping to ensure that both additives are dissolved and mixed uniformly in the methanol. This fuel blend has better lubricity and results in less wear and corrosion in the engine than methanol alone.

Thus, the present invention provides a methanol fuel and a method of preparing such fuel which allows the use of methanol as a replacement for gasoline while maintaining adequate lubricity to prevent engine wear. In addition, certain of the additives can provide increased cold start ability and lower the volatility of methanol fuel.

While certain embodiments and details have been shown for the purpose of illustrating this invention, it will be apparent to those skilled in this art that various changes and modifications may be made herein without departing from the spirit or scope of the invention.

We claim:

1. A method for preparing a methanol fuel comprising adding to said methanol fuel from about 0.05 to about 15% by volume of a lubricating additive or a mixture of lubricating additives comprising polyol esters having the general formula $$R_1(CH_2OC\overset{O}{\overset{\|}{}}R_2)_x,$$

where $R_1$ and $R_2$ are, independently, linear or branched acyclic, alicyclic, cyclic, or aryl groups containing from 1 to 30 carbon atoms and x is 2–4; and the total number of carbon atoms in $R_1$ and $R_2$ is from 10 to 40.

2. A method for reducing wear in engines operating on fuel containing a majority of methanol by volume comprising adding to said fuel a polyol ester lubricity additive or mixtures of polyol ester lubricity additives having the general formula $$R_1(CH_2OC\overset{O}{\overset{\|}{}}R_2)_x,$$

wherein $R_1$ and $R_2$ are, independently, linear or branched acyclic, alicyclic, cyclic, or aryl groups containing from 1 to 30 carbon atoms, wherein x is from 2 to 4 and the total number of carbon atoms in $R_1$ and $R_2$ is from 10 to 40.

3. A method as described in claim 2 wherein the fuel is substantially totally methanol prior to additive addition.

4. A method as described in claim 3 wherein the additives are present at levels of from about 0.05 to about 15% by volume.

5. A method as described in claim 4 wherein the additives are present at levels of from about 0.1 to about 5% by volume.

6. A method as described in claim 3 wherein the additive is a polyol ester selected from the group consisting of pentaerythritol valerate, trimethylolpropane nonate, neopentylglycol octoate, and pentaerythritol heptanoate.

7. A method as described in claim 1 wherein the additive is a polyol ester selected from the group consisting of pentaerythritol valerate, trimethylolpropane nonate, neopentylglycol octoate, and pentaerythritol heptanoate.

* * * * *